US007208664B1

(12) United States Patent
Regenberg et al.

(10) Patent No.: US 7,208,664 B1
(45) Date of Patent: Apr. 24, 2007

(54) ACOUSTIC STRINGED INSTRUMENT WITH IMPROVED CUTAWAY AND NECK-BODY JOINT

(76) Inventors: Richard F. Regenberg, 113 Ponwood Cir., Madison, WI (US) 53717; David C. Regenberg, 4577 Stonewood Dr., Middleton, WI (US) 53562

( * ) Notice: Subject to any disclaimer, the term of this patent is extended or adjusted under 35 U.S.C. 154(b) by 20 days.

(21) Appl. No.: 11/188,189

(22) Filed: Jul. 22, 2005

(51) Int. Cl.
*G10D 1/08* (2006.01)

(52) U.S. Cl. ..... 84/267; 84/293; 84/291; 84/290

(58) Field of Classification Search ..... 84/267, 84/291, 292, 293, 290
See application file for complete search history.

(56) References Cited

U.S. PATENT DOCUMENTS 5,125,311 A * 6/1992 Boulanger et al. ..... 84/291
5,233,122 A * 8/1993 Kim ..... 84/293
5,886,272 A 3/1999 Regenberg

* cited by examiner

*Primary Examiner*—Kimberly Lockett
(74) *Attorney, Agent, or Firm*—Mark D. Kelly

(57) ABSTRACT

An acoustic stringed instrument includes a multi-tiered neck-body joint that removably secures the neck to the body, provides a superior structural and acoustical coupling and enables an expanded treble cutaway that provides improved access to higher regions of the neck and elimination of the neck heel and other external structures in the vicinity of the neck joint.

15 Claims, 4 Drawing Sheets

ACOUSTIC STRINGED INSTRUMENT WITH IMPROVED CUTAWAY AND NECK-BODY JOINT

TECHNICAL FIELD

The present invention relates to acoustic stringed instruments and more particularly to a neck-body joint for an acoustic stringed instrument that provides a superior structural and acoustical coupling of the neck and body and enables an expanded cutaway that provides improved access to higher regions of the fingerboard.

BACKGROUND

Previous patents to one or both inventors hereunder, "Guitar with Captive Neck Joint," U.S. Pat. No. 5,886,272, issued on Mar. 23, 1999 and "Guitar with Controlled Neck Flex" U.S. Pat. No. 6,051,765, issued on Apr. 18, 2000 are incorporated herein by reference as if fully set forth. Although guitar embodiments are particularly described herein, alternative embodiments according to the present invention may readily be adapted to other acoustic stringed instruments. A conventional acoustic guitar includes a hollow or semi-hollow resonant wooden body and an elongate neck that is joined to the body on one end. A number of strings, typically numbering 4, 6, or 12, are secured under tension between a bridge positioned near the tail end of the body opposite the neck, and tuning machines or pegs located at the head end of the neck. A fretted fingerboard overlies the neck and, also typically extends over part of the body. The tensioned string are made to vibrate by plucking or strumming with one hand positioned over the body while the other hand moves over the neck depressing the strings against the frets of the fingerboard to effect pitch changes.

The acoustic guitar body is formed from a generally flat top or soundboard, a backboard that is also generally flat and parallel to the top and an orthogonal sidewall between the top and back. While the body can have a variety of shapes, typically it is pear-shaped in profile and includes three regions: an upper bout that is closest to the neck, a narrower waist in the middle, and a relatively large lower bout at the tail end, opposite the neck. The pear shaped body style has been a standard and favored since the inception of the acoustic due, in part, to its acoustical properties, comfort, and structural characteristics including ample support in the area of the neck joint.

The importance of a strong neck joint can not be overemphasized. The tensioned bronze and steel strings of an acoustic guitar exert considerable force on the structure joining the neck to the body, typically more than that of an electric or classical guitar. Even a slight instability or misalignment of the neck joint will adversely affect the tuning, action, and overall sound quality of an instrument and render an otherwise fine instrument difficult or impossible to play. Moreover, vibrational energy from the strings can be dissipated in a neck joint that is not well constructed and properly set, resulting in a loss of sustain and tonal quality.

Traditionally, a glued joint such as the dovetail has been favored for mounting the neck of an acoustic guitar. The dovetail joint includes a tenon cut into a thick downward protrusion at the base of the neck known as the "heel," and a corresponding mortise to receive the tenon that is cut into a structure at the neck end of the guitar body referred to as the "neck block." The dovetail tenon has a "V" shaped cross section that tapers down and away from the neck. The side faces flare out toward a flat front face to form the characteristic dovetail shape. A well constructed permanently glued dovetail neck joint, provides a secure acoustical and mechanical coupling. However, even the most skillfully set neck joint may eventually become misaligned as the wood changes shape in response to changes in temperature and humidity. Resetting a dovetail neck joint is a major repair that requires the skills of a master guitar maker/repairperson.

To avoid the problem of resetting a permanently glued neck, some acoustic guitars employ hardware fasteners such as bolts, screws, and the like to mount the neck to the body. The use of hardware in place of the traditional fitted and glued joinery enables the neck to be removed, replaced, and realigned more easily and can reduce the cost of manufacturing, shipping, and set-up. Modern bolt-on acoustic guitars that are well designed and crafted can provide neck joints that have good mechanical and acoustical coupling.

Regardless of the type of neck joint employed, acoustic guitars typically include reinforcement structures in and around the neck joint to add stability and counteract the string tension. These structures may include a large upper bout surrounding the neck joint, substantial thickening and/or widening of the neck in the vicinity of the neck joint; a heel that projects out from the body and extends downward at the base of the neck; external hardware braces and supports, and the like. Unfortunately, such external body structures in the area of the neck joint will impede access to the highest frets, especially frets positioned on the fingerboard extension overlying the body. On the lower frets, a player is able to grasp the neck between the thumb and fingers, placing the thumb either behind the neck or on the side to provide support for the hand and to oppose the force of the fingers pressing down on the strings. However, to play notes on frets positioned on the fingerboard extension, the player must extend the fingers over the body beyond the position of the thumb. As the hand stretches farther and farther to reach the highest notes, less support is provided by the thumb and the hand position becomes more awkward and difficult. Because of the challenges presented in accessing the highest frets, they are often simply not used by acoustic guitar players, particularly those with smaller hands.

To improve access to the highest frets, a cutaway or recess may be provided in the upper bout on the treble side of the fingerboard and neck. The treble cutaway reduces the amount of stretch required to access some of the higher frets on the neck and fingerboard extension but typically stops short of the neck where additional support structure juts out to buttress the area weakened by the cutaway. This structure underlies the neck and prevents the player from placing the thumb in a normal or near normal position behind or on the side of the neck and requires more hand stretch to reach frets on the fingerboard extension. While acoustic guitar cutaways that extend under the neck have been attempted, the designs are often quite complex and/or provide inadequate structural stability and typically reposition support members to make room for the expanded cutaway, employing devices such as offset neck joints; offset elongated neck heels, and other displaced support structures.

From the foregoing, it is apparent that there is a need for a system and method for attachment of the neck to the body of an acoustic guitar that provides uncompromised structural support of the neck, superior acoustical coupling and at the same time provides better playability and "reach" of notes on the highest frets without significantly altered playing technique.

SUMMARY

In general, in one aspect, an acoustic stringed instrument according to an embodiment of the present invention includes a substantially hollow body extending longitudinally between a neck receiving end and a tail end, and the body includes a soundboard and a support structure. The support structure has a unitary neck support secured in the body substantially adjacent the neck receiving end that has a top surface substantially parallel to the soundboard. The elongate neck also includes a fingerboard joined to a top surface and provides an insert disposed at one end of the neck in substantial transverse alignment therewith. The insert has a substantially planar bottom surface that projects from the underside of the neck to a first level and an abutment surface disposed underneath the neck and substantially adjacent to the insert, offset however from the planar bottom surface at a second shallower level. In another aspect, an inner recess is formed in the top surface of the neck support that has a substantially planar floor and a number of walls extending up from the floor. The inner recess is dimensioned to receive and snugly engage the neck insert.

In another aspect, an outer lip extends away from the inner recess in the direction of the neck receiving end and is offset upwardly from the planar floor. The outer lip providing an abutment surface that is dimensioned and shaped to conform with and engage the abutment surface of the neck.

In general, in another aspect, a method for securing a neck to a body of an acoustic stringed instrument includes providing a substantially hollow body that extends longitudinally between a neck receiving end and a tail end, which includes a soundboard and a support structure, the support structure having a unitary neck support secured in the body substantially adjacent the neck receiving end that has a top surface substantially parallel to the soundboard. In another aspect the method includes providing an elongate neck having a fingerboard joined to a top surface and which also provides an insert disposed at one end in substantial transverse alignment with the neck. The insert has a substantially planar bottom surface that projects from the underside of the neck to a first level; and also has an abutment surface adjacent to the insert and in substantial transverse alignment with the insert but offset from the planar bottom surface at a second shallower level.

The method also includes forming an inner recess in the top surface of the neck support that has a substantially planar floor and a number of walls extending up from the floor which is dimensioned to receive and engage the neck insert. The method also includes forming an outer lip extending away from the inner recess in the direction of the neck receiving end of the body but offset upwardly from the planar floor of the inner recess. This outer lip is dimensioned and shaped to conform with and engage the abutment surface of the neck.

In another aspect, the method includes positioning and dimensioning the insert and the corresponding pocket surfaces to direct and distribute the force of the tensioned strings through and behind the unitary neck support in order to urge the neck more securely into the pocket.

In yet another aspect, the method includes providing a relief cut in the body that defines a treble cutaway beneath the neck that continues and extends transversely underneath the neck to provide improved access to higher positions on the fingerboard.

DETAILED DESCRIPTION

In the following detailed description, reference is made to the accompanying drawings that form a part hereof, and in which are shown by way of illustration specific embodiments in which the invention, as claimed, may be practiced. This invention may, however, be embodied in many different forms and should not be construed as limited to the embodiments set forth; rather, these embodiments are provided so that this disclosure will be thorough and complete, and will fully convey the scope of the invention to those skilled in the art. As will be appreciated by those of skill in the art, the present invention may be embodied in methods and devices. Wherever possible, the same reference numbers will be used throughout the drawings to refer to the same or like parts.

Figure 1:
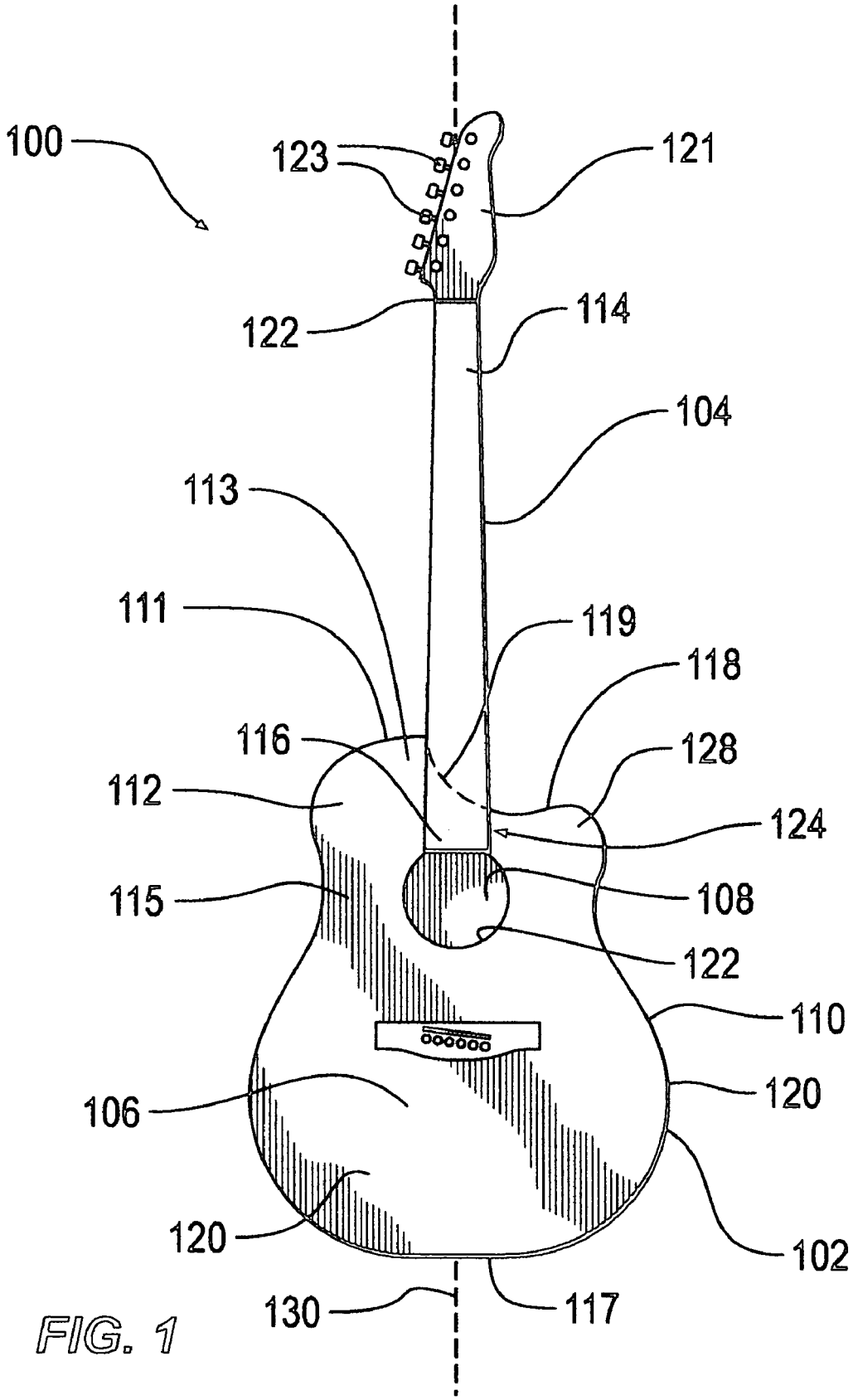
FIG. 1 is a front elevational view of the preferred embodiment of an acoustic stringed instrument according to the present invention.
Figure 2:
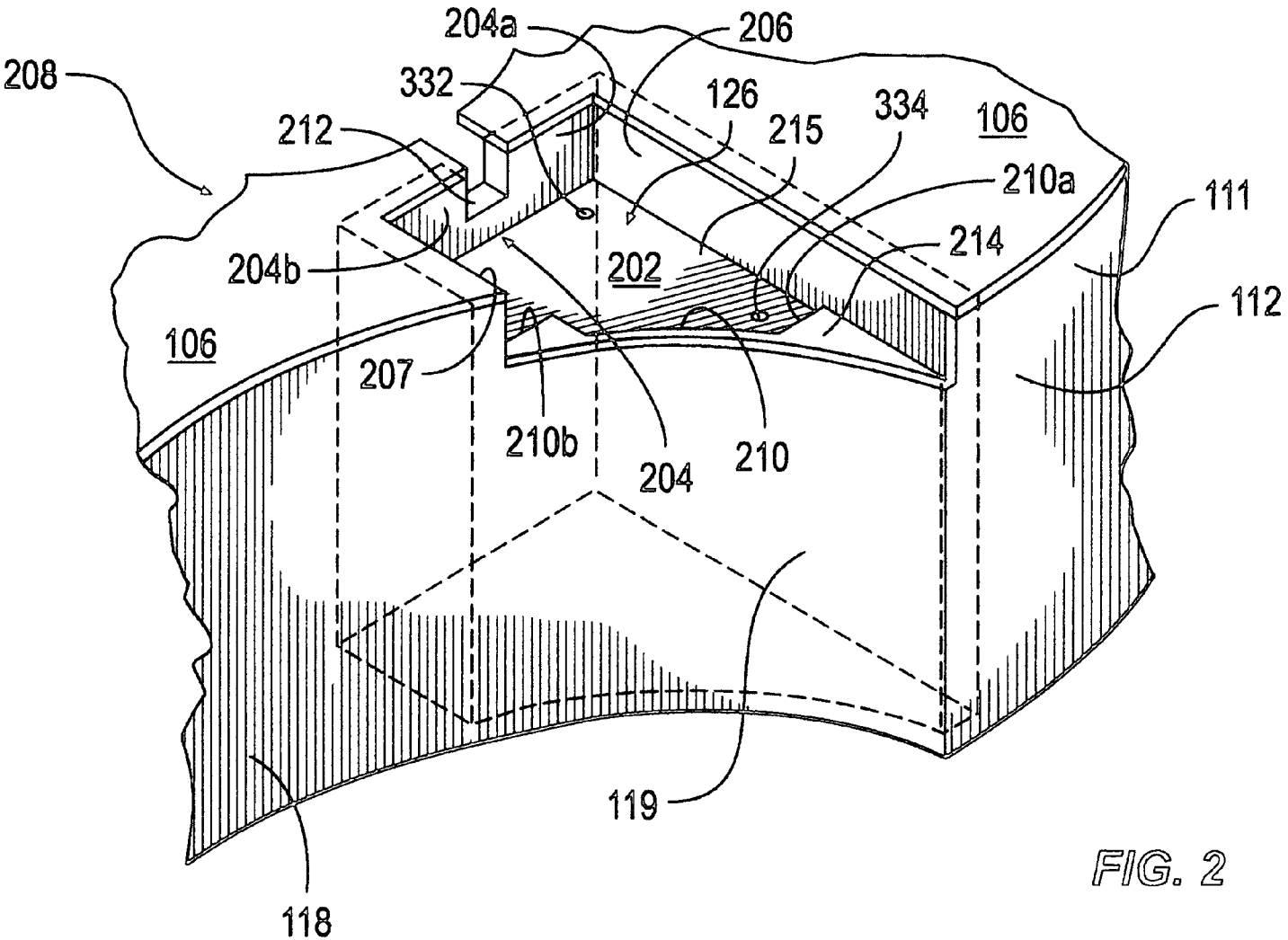
FIG. 2 is a perspective view of the neck joint pocket of the preferred embodiment of an acoustic stringed instrument according to the present invention.
Figure 3:
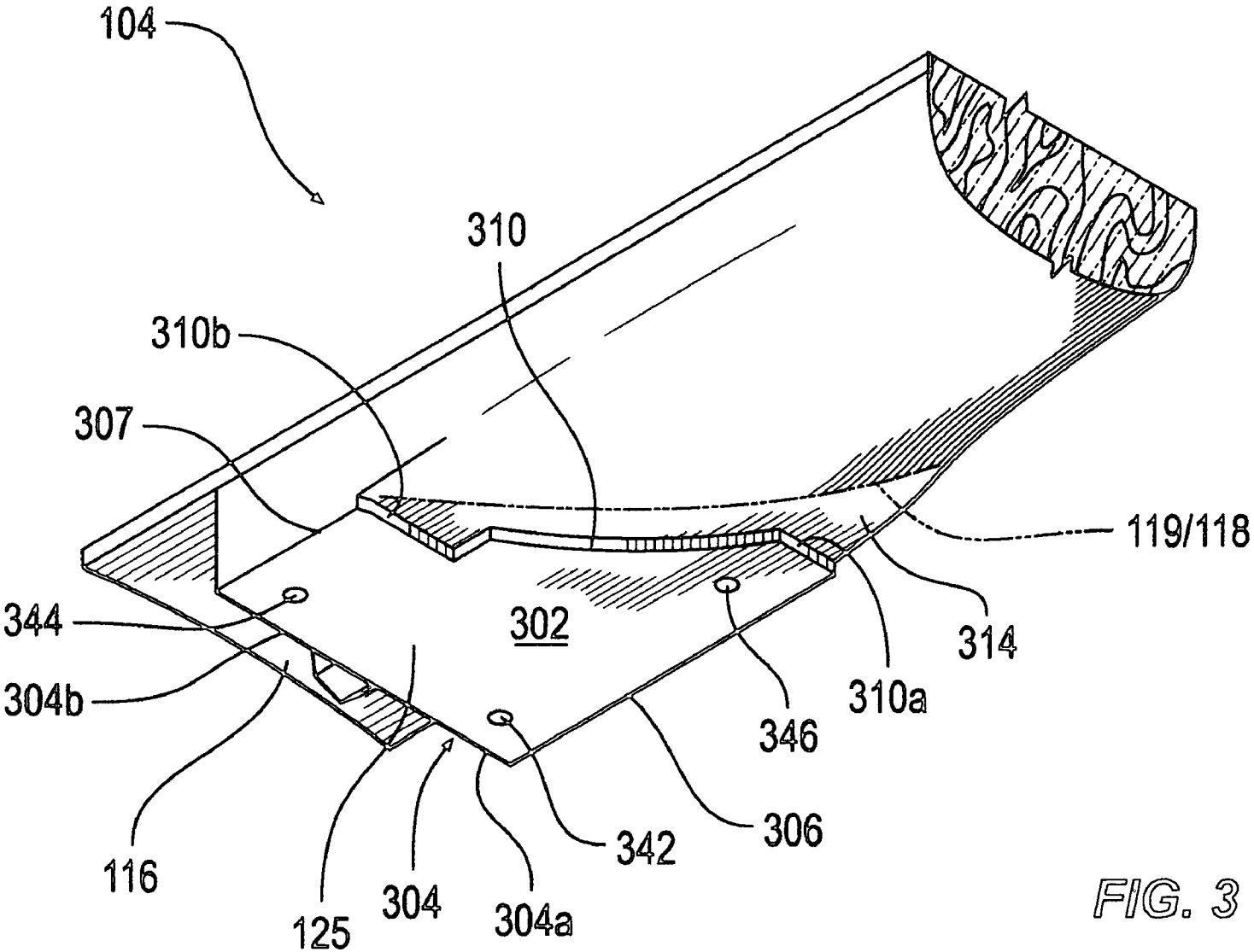
FIG. 3 is a perspective view of the neck joint insert of the preferred embodiment of an acoustic stringed instrument according to the present invention.
Figure 4:
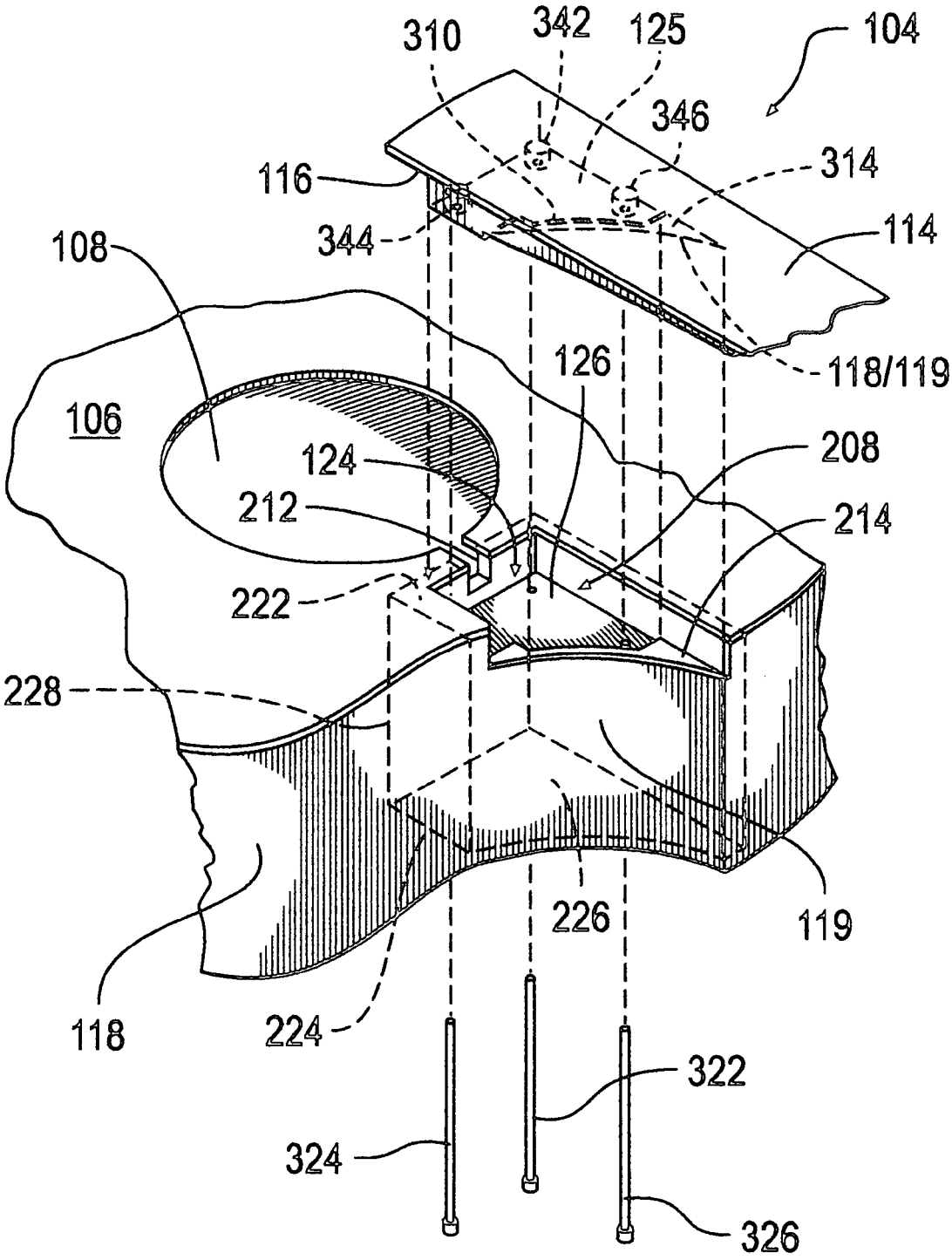
FIG. 4 is an exploded perspective view of the neck joint and cutaway region of the preferred embodiment of an acoustic stringed instrument according to the present invention

FIG. 1 shows a front perspective view of a preferred embodiment of an acoustic guitar 100 according to the present invention. Acoustic guitar 100 includes an elongate neck 104 centered on a longitudinal axis 130 and joined on end to a resonant hollow body 102 at a neck support such as neck block 208. Body 102 has a generally flat top or soundboard 106 and support structures that form a resonant cavity with soundboard 106, including a backboard 108 that is also generally flat and a contoured generally orthogonal sidewall 110 therebetween. Although body 102 may be made from a variety of non-traditional materials including plastics, composites and metals, it is preferably made from tonewood sections that are selected, cut, and joined together to optimize acoustical and structural properties. Woods frequently selected for back 108 and sidewall 110 include rosewood, maple and mahogany. Soundboard 106 is often made from select spruce or cedar. Neck 104 is preferably carved from a straight grained hardwood stock favored for its acoustical and structural properties such as maple, rosewood or mahogany, and may also include one or more internal longitudinal struts or truss rods for reinforcement, to counteract neck curvature and precisely adjust the neck angle. While the instrument shown in FIGS. 1–4 provides a flat top and back and a substantially orthogonal sidewall, in alternative embodiments, the body may be shaped differently and may include, for example, a curved top, and/or a curved or sloping back or provide a support structure that combines the backboard and sidewall.

Body 102 may be divided longitudinally into three general regions: a broad lower bout 120 at a tail end 117, i.e., the end opposite the neck 104, a narrower waist 115 in the middle, and an upper bout 112 near the neck 104. Neck 104 extends longitudinally from a headstock 121 to which tuning machines 123 are attached, to a neck insert 125 at the opposite end which is received by a pocket 126 in body 102 at neck-body joint 124. A fretted fingerboard 114 overlies neck 104 extending from a nut 122 that provides a nodal point over which the strings pass and continues past neck joint 124 in a tongue-like extension 116 that overlies soundboard 106 and provides space for a number of additional frets. Fingerboard extension 116 terminates at an opening or port in soundboard 106 such as sound hole 122, positioned approximately in the middle of soundboard 106. Neck 104 progressively widens slightly as it extends from nut 122 to neck joint 124, as is conventional for acoustic guitars.

Sidewall 110, which may be made from a single continuous piece, or may be constructed from several joined sections, is divided for reference into an upper sidewall 111 in the region above neck 104 and a lower sidewall 118 below neck 104. Upper sidewall 111 and lower sidewall 118 curve to form a generally pear shaped profile that is substantially symmetric about longitudinal axis 130 with the exception of an expanded relief cut or cutaway 119 which is dimensioned to provide greater access to the highest frets on fingerboard 114, especially those frets overlying soundboard 106 on fingerboard extension 116. As shown in FIG. 1 (in phantom), cutaway 119 extends underneath neck 104 from lower sidewall 118 to upper sidewall 111 in a uniformly continuous extension of the contour or line established by the cutaway in lower sidewall 118. An extended cutaway 119 that continues underneath the neck exposes a substantial additional portion of the back of the neck. This facilitates access to the upper frets and avoids awkward stretches or other significantly altered technique. While a circular contour is illustrated for cutaway 119, it is contemplated that cutaway 119 may form other shapes including parabolic or elliptic curves, straight line sections such as "L" or "V" shapes, or combinations of curves and straight lines and the like.

The sound quality, frequency response, sustain, power, and projection of an acoustic guitar are influenced by the efficiency with which vibrational energy produced by the strings is transferred to the soundboard and other sound producing structures, and the ability of those structures to freely vibrate. At the same time a practical instrument must be rigid and strong enough to oppose the force of the tensioned strings without excessive deformation. Structures and supports that are too massive will dampen and distort the response of the instrument. In particular, conventional cutaway acoustic guitars typically add structure and mass to the body under the neck to oppose the downwardly directed component of force exerted by the tensioned strings and to compensate for reduced support resulting from the cutaway. Embodiments of acoustic stringed instruments according to the present invention solve this problem in a different way by providing a neck joint that directs and distributes the force of the tensioned strings through and behind a primary neck support such as neck block 208 toward tail 117. Neck block 208 provides a relatively small, unitary support structure positioned between upper sidewall 111 and lower sidewall 118 opposite tail end 117 and substantially centered transversely on longitudinal axis 130. Neck block 208 includes a top surface 222 that is joined around the perimeter to the inside surface of soundboard 106, a bottom surface 224 that is joined to the inside surface of backboard 108, a front surface 226 joined to the inside surface of sidewall 111 and which conforms to the contour thereof, and a rear surface 228 that forms the back end of neck block 208. Neck block 208 provides both a structural and acoustical coupling between neck 104 and body 102, and, as such, is constructed of a material that is rigid, strong, and firmly secured inside body 102 by gluing, bracing and the like. Only a narrow perimeter of top surface 222 is joined to soundboard 106 to avoid unnecessary damping of soundboard 106 and all but this perimeter region of soundboard 106 overlying top surface 222 is removed to expose the relatively rigid top surface 222 for direct coupling of neck 104. Hardwoods such as maple, rosewood or mahogany are generally preferred for neck block 208. Other embodiments according to the present invention may provide a neck support made from one or more of wood, plastic, composite, metal, or combinations thereof.

Pocket 126 is centered transversely on longitudinal axis 130 in top surface 222 of neck block 208 and includes two general regions: an outer lip 214 and an adjacent inner recess 215 each disposed on a distinct tier or level. Outer lip 214 provides an abutment surface for a correspondingly shaped and positioned abutment surface 314 on neck 104 and is bounded on the outside by lower sidewall 118 and on the inside by a forward restraint wall 210 of inner recess 215. Outer lip 214 is positioned above inner recess 215. In this embodiment, outer lip 214 is recessed to a level just below soundboard 106 to be substantially coplanar with neck block top surface 222. A slight recessing of outer lip 214 will enable lower placement of the strings and provide better acoustic coupling of neck 104 with body 102. In alternative embodiments, the surface of outer lip 214 may conform to the natural contour of the underside of neck 104. Still other alternative embodiments may provide corresponding abutment surfaces 214 and 314 that are angled with respect to the plane of soundboard 106. Abutment surface 314 may also be recessed or elevated with respect to the surface of the underside of neck 104 to engage a correspondingly elevated or recessed outer lip 214.

Inner recess 215 is formed in neck block 208 inside of and adjacent to outer lip 214 and at a level below the level of outer lip 214. Inner recess 215 is dimensioned to snugly receive neck insert 125 and provides a substantially planar floor 202 and walls that extend upwardly from floor 202, including a forward restraint wall 210 in the direction of headstock 121, a rear restraint wall 204 positioned opposite forward restraint wall 210 toward tail 117, an upper side restraint wall 206 positioned toward the top portion 113 of upper bout 112, and a lower side restraint wall 207 substantially opposite upper wall 206. The walls of inner recess 215 are preferably orthogonal to floor 202 to enable neck 104 to be easily inserted from above. Forward restraint wall 210 or rear restraint wall 204 may be canted in so long as the angle does not interfere with insertion of the neck. Side restraint walls 206 and 207 preferably diverge as they extend toward tail 117 to conform to the shape of insert 125 at the end of neck 104 which progressively widens as an extension of the neck. Lower side restraint wall 207 is shorter in the longitudinal direction than upper side restraint wall 206 to accommodate the expanded cutaway 119. In alternative embodiments, lower side restraint wall 207 may be further shortened, or eliminated entirely, to expose more of the underside of the neck and achieve an even deeper cutaway. Although both forward restraint wall 210 and rear restraint wall 204 are preferably planar surfaces that are substantially orthogonal to longitudinal axis 130 it is contemplated that alternative embodiments may provide an angled rear restraint wall 204 and/or a forward restraint wall 210 or that such surfaces may be non planar or curved and that neck insert surfaces will be correspondingly matched.

As shown in the drawings, rear restraint wall 204 is divided into an upper rear restraint wall section **204*a* and a lower rear restraint wall section 204*b* to accommodate a truss rod adjustment opening 212** in between. In alternative embodiments the truss rod adjustment may be accessed from an opening at the top of the neck, or eliminated entirely, and an undivided rear restraint wall provided.

Forward restraint wall 210, positioned opposite rear restraint wall 204, may be divided into two parallel sections, an upper forward restraint wall section 210*a* and a lower forward restraint wall section 210*b*. Parallel forward restraint wall sections 210*a* and 210*b* are staggered longitudinally to provide a larger surface area for pocket floor 202 and a larger surface area or "footprint" for insert 125. The larger footprint provides a corresponding reduction in stress improves opposition to lateral loads and enables greater precision in neck alignment.

Insert 125 forms a downwardly projecting footprint positioned underneath neck 104 and centered transversely on longitudinal axis 130. Insert 125 substantially conforms to the shape of inner recess 215 and is dimensioned to fit snugly within. Insert 125 includes a bottom planar surface 302 that corresponds to pocket floor 202, an end wall 304 (divided in this embodiment into sections 304*a* and 304*b*) that engages pocket rear restraint wall 204, and a forward wall 310 (divided in this embodiment into corresponding sections 310*a* and 310*b*) that engages pocket forward restraint wall 210. Abutment surface 314 is positioned adjacent insert 125 to overlie and substantially correspond in area and surface contour to outer lip 214.

Insert 125 further includes opposing sidewalls 306 and 307 corresponding to pocket sidewalls 206 and 207 which similarly diverge to correspond to the progressive widening neck. Insert 125 completely underlies neck 104 without requiring lateral displacement or addition of any joint support structures such as offset projections, tabs, heels, tenons, and the like. Additionally, in contrast to conventional neck heels which typically extend down from the neck for several inches, neck insert 125 provides a low profile projection, typically protruding only an additional 0.125 and 0.5 inches from the underside of the neck. Properly seated in recess 126, this relatively shallow projection achieves excellent joint stability and superior acoustic coupling. Moreover, the entire neck and insert may be carved from the same stock of wood eliminating the need for joining a downwardly projecting section at the base as is usually required for a conventional heel.

While the string tension of conventional acoustic instruments typically acts against the neck joint and may eventually pull the joint surfaces apart, the alignment and structural support provided by a neck joint of an embodiment of an acoustic stringed instrument according to the present invention is such that the force exerted by the tensioned strings actually urges insert 125 more securely into pocket 126.

A number of fasteners are employed to removably secure neck 104 to body 102. In the preferred embodiment, three spaced threaded fasteners 322, 324 and 326 preferably are close tolerance machine threaded screws, studs, or bolts are provided to facilitate installation, adjustment and removal and to compress the joint surfaces together for optimum mechanical and acoustical coupling. Other fastening devices such as pins, rivets, nails, wood screws or the like may be employed in alternative embodiments. Fasteners 322, 324 and 326 are inserted through openings 332, 334, and 336 in the back of the body 102, are seated against or countersunk into the base of neck block 208 and extend orthogonally through planar floor 202 into insert 125 where they are received by threaded metal inserts 342, 344, and 346, or the like. Fasteners 322, 324 and 326 are preferably arranged in a right triangle with one leg substantially parallel to longitudinal axis 130. Fasteners 332 and 336 are equidistant from longitudinal axis 130 and generally are spaced as widely apart as practicable within recess 215. No more than three fasteners are needed to secure a neck joint of an embodiment according to the present invention.

Embodiments of acoustic stringed instruments according to the present invention are capable of providing an exceptionally strong neck-body joint that will resist rotational and translational movement of the neck without the need for angled sidewalls or glued mating surfaces such as are required for construction of a traditional dovetail joint. Additionally, embodiments of acoustic stringed instruments according to the present invention provide a multi-tiered pocket formed in a top surface of a body neck block which includes a planar floored inner recess at a first level tier dimensioned to engage a corresponding planar faced insert projecting from underneath the neck, and an outer abutment surface adjacent to the inner recess at a second and higher level to engage a corresponding abutment surface adjacent the neck insert. with increasing strength and maintain correct alignment in response to tension exerted by the strings of the instrument.

CONCLUSION

As has been shown, embodiments of the present invention provide an acoustic guitar with a removably secured neck joint that provides exceptional strength and acoustic coupling. In addition, embodiments according to the present invention provide an acoustic guitar with a progressively widening neck that avoids excessive width in the vicinity of the neck joint and maintains substantially the same thickness extending toward the neck joint. Additionally, embodiments according to the present invention provide an acoustic guitar with a significantly expanded cutaway that extends underneath the entire neck and provides exceptional access to highest frets. It will be understood that various modifications to the described embodiments may be made without departing from the spirit and scope of the claimed invention. For example, while the present invention is illustrated for an acoustic guitar, those of ordinary skill in the art will recognize that embodiments may be realized in other acoustic stringed instruments that include a neck joined on end to a resonant body, such as the mandolin, lute, banjo, bouzouki, balalaika, violin, viola, cello and bass. Accordingly, other embodiments are within the scope of the invention, which is limited only by the following claims.

What is claimed is:

1. An acoustic stringed instrument comprising:

a substantially hollow body extending longitudinally between a neck receiving end and a tail end, the body including a soundboard and a support structure, the support structure having a unitary neck support secured in the body substantially adjacent the neck receiving end that has a top surface substantially parallel to the soundboard;

an elongate neck comprising a fingerboard joined to a top surface and further providing an insert disposed at one end of the neck in substantial transverse alignment therewith, the insert having a substantially planar bottom surface that projects from the underside of the neck to a first level; and an abutment surface disposed underneath the neck and substantially adjacent to the insert, offset from the planar bottom surface at a second shallower level; and an inner recess in the top surface of the neck support comprising a substantially planar floor and a plurality of walls extending up from the floor, the inner recess dimensioned to receivingly engage the neck insert; and an outer lip extending away from the inner recess in the direction of the neck receiving end and offset upwardly from the planar floor, the outer lip providing an abutment surface that is dimensioned and shaped to conform with and engage the abutment surface of the neck.

2. The acoustic stringed instrument of claim 1 further comprising a uniformly continuous relief cut in the body that defines a treble cutaway adjacent to and extending underneath the neck, wherein improved access is provided to regions of the fingerboard that are close to the body or that overlie the soundboard.

3. The acoustic stringed instrument of claim 2 wherein the relief cut comprises a curvilinear profile and extends the treble cutaway underneath the neck and substantially to the opposite side thereof.

4. The acoustic stringed instrument of claim 1 further comprising fasteners to removably secure the neck to the body.

5. The acoustic stringed instrument of claim 1 wherein the top surface of the neck support is joined around the perimeter to the inside surface of the soundboard.

6. An acoustic stringed instrument, comprising:

an elongate neck that includes a downwardly projecting substantially flat bottomed low profile insert at one end in substantial transverse alignment with the neck and provides a shallower abutment surface adjacent to the insert, and a substantially hollow body that extends longitudinally between a tail end and a neck receiving end at which the neck is joined, the body including a soundboard and a support structure, the support structure comprising a neck block substantially adjacent the neck receiving end, the neck block comprising:

a multi-tiered pocket formed in a top surface of the neck block which includes a substantially planar floored inner recess at a first tier level dimensioned to engage the flat bottomed low profile insert projecting from underneath the neck, and an outer abutment surface adjacent to the inner recess disposed at a second, higher tier level to engage the abutment surface adjacent the neck insert.

7. The acoustic stringed instrument of claim 6 wherein the abutment surface is substantially planar and parallel to the surface of the flat bottomed insert.

8. The acoustic stringed instrument according to claim 6 wherein the inner recess further comprises a forward restraint wall positioned toward the neck receiving end that extends up from the floor and a rear restraint wall extending up from the floor opposite the forward restraint wall, first and second opposing sidewalls which extend up from the floor.

9. The acoustic stringed instrument according to claim 8 wherein the forward restraint wall is substantially orthogonal to the floor.

10. The acoustic stringed instrument according to claim 9 wherein the rear restraint wall is substantially orthogonal to the floor and substantially parallel to the forward restraint wall.

11. The acoustic stringed instrument according to claim 10 wherein the first and second sidewalls diverge extending away from the neck receiving end.

12. The acoustic stringed instrument according to claim 8 wherein the forward restraint wall comprises one or more sections and substantially conforms to the contour of a relief cut in the neck receiving end.

13. The acoustic stringed instrument according to claim 12 wherein the forward restraint wall comprises a plurality of longitudinally staggered parallel sections.

14. A method for securing a neck to a body of an acoustic stringed instrument, comprising:

providing a substantially hollow body that extends longitudinally between a neck receiving end and a tail end, the body including a soundboard and a support structure, the support structure having a unitary neck support secured in the body substantially adjacent the neck receiving end that has a top surface substantially parallel to the soundboard;

providing an elongate neck comprising a fingerboard joined to a top surface and further providing an insert disposed at one end of the neck in substantial transverse alignment therewith, the insert having a substantially planar bottom surface that projects from the underside of the neck to a first level; and further comprises an abutment surface adjacent to the insert and in substantial transverse alignment therewith, offset from the planar bottom surface at a second shallower level;

forming an inner recess in the top surface of the neck support comprising a substantially planar floor and a plurality of walls extending up from the floor, the inner recess dimensioned to receivingly engage the neck insert;

forming an outer lip extending away from the inner recess in the direction of the neck receiving end and offset upwardly from the planar floor, the outer lip dimensioned and shaped to conform with and engage the abutment surface of the neck; and positioning and dimensioning the insert and corresponding pocket surfaces to direct and distribute the force of the tensioned strings through and behind the unitary neck support to urge the neck more securely into the pocket.

15. The method of claim 14 further comprising providing a relief cut in the body that defines a treble cutaway beneath the neck that continues and extends transversely underneath the neck to provide improved access to higher positions on the fingerboard.

* * * * *